US010765215B2

(12) United States Patent
Hummel

(10) Patent No.: US 10,765,215 B2
(45) Date of Patent: Sep. 8, 2020

(54) ITEM OF SEATING FURNITURE IN TWO-SHELL DESIGN FOR HOLDING DECAL SHEETS

(71) Applicant: PARTY RENT SCHWEIZ AG, Birsfelden (CH)

(72) Inventor: Sven Hummel, Mainz (DE)

(73) Assignee: PARTY RENT SCHWEIZ AG, Birsfelden (CH)

( * ) Notice: Subject to any disclaimer, the term of this patent is extended or adjusted under 35 U.S.C. 154(b) by 0 days.

(21) Appl. No.: 16/068,359

(22) PCT Filed: Jan. 3, 2017

(86) PCT No.: PCT/DE2017/100002

§ 371 (c)(1),
(2) Date: Jul. 5, 2018

(87) PCT Pub. No.: WO2017/118454

PCT Pub. Date: Jul. 13, 2017

(65) Prior Publication Data

US 2019/0014905 A1 Jan. 17, 2019

(30) Foreign Application Priority Data

Jan. 4, 2016 (DE) ..... 20 2016 100 003 U

(51) Int. Cl.

| | |
|---|---|
| ***A47C 3/12*** | (2006.01) |
| ***A47C 7/62*** | (2006.01) |
| ***G09F 23/00*** | (2006.01) |

(52) U.S. Cl.

CPC ..... *A47C 3/12* (2013.01); *A47C 7/62* (2013.01); *G09F 23/00* (2013.01); *G09F 2023/005* (2013.01)

(58) Field of Classification Search

CPC ..... A47C 7/62; A47C 3/12

See application file for complete search history.

(56) References Cited

U.S. PATENT DOCUMENTS

| | | | | |
|---|---|---|---|---|
| 2,711,786 | A | 6/1995 | Weiss | |
| 2003/0107247 | A1* | 6/2003 | Wills | A47C 7/70 297/217.1 |

FOREIGN PATENT DOCUMENTS

| | | |
|---|---|---|
| DE | 102009016924 | 10/2010 |
| IT | MO910051 | 10/1992 |
| WO | WO2007076870 | 7/2007 |

OTHER PUBLICATIONS

International search report dated Apr. 12, 2017 from corresponding application No. PCT/DE2017/100002.

* cited by examiner

*Primary Examiner* — Anthony D Barfield

(74) *Attorney, Agent, or Firm* — Hauptman Ham, LLP

(57) ABSTRACT

The invention relates to a piece of seating furniture formed from two seat shells connected to one another, which form a seating surface and a backrest of the piece of seating furniture as a connected component, wherein the upper and lower seat shells connected to form the piece of seating furniture are designed approximately identically in construction and same are connected to one another only in the edge region thereof such that a free, narrow and flat gap space remains between the seat shells which holds a decal sheet via a slot-shaped access opening on the top side of the backrest and/or on the front edge of the seating surface and/or in the rear surface of the piece of seating furniture, which decal sheet is approximately the size of the surface of the piece of seating furniture.

19 Claims, 8 Drawing Sheets

ITEM OF SEATING FURNITURE IN TWO-SHELL DESIGN FOR HOLDING DECAL SHEETS

RELATED APPLICATIONS

Figure 1:
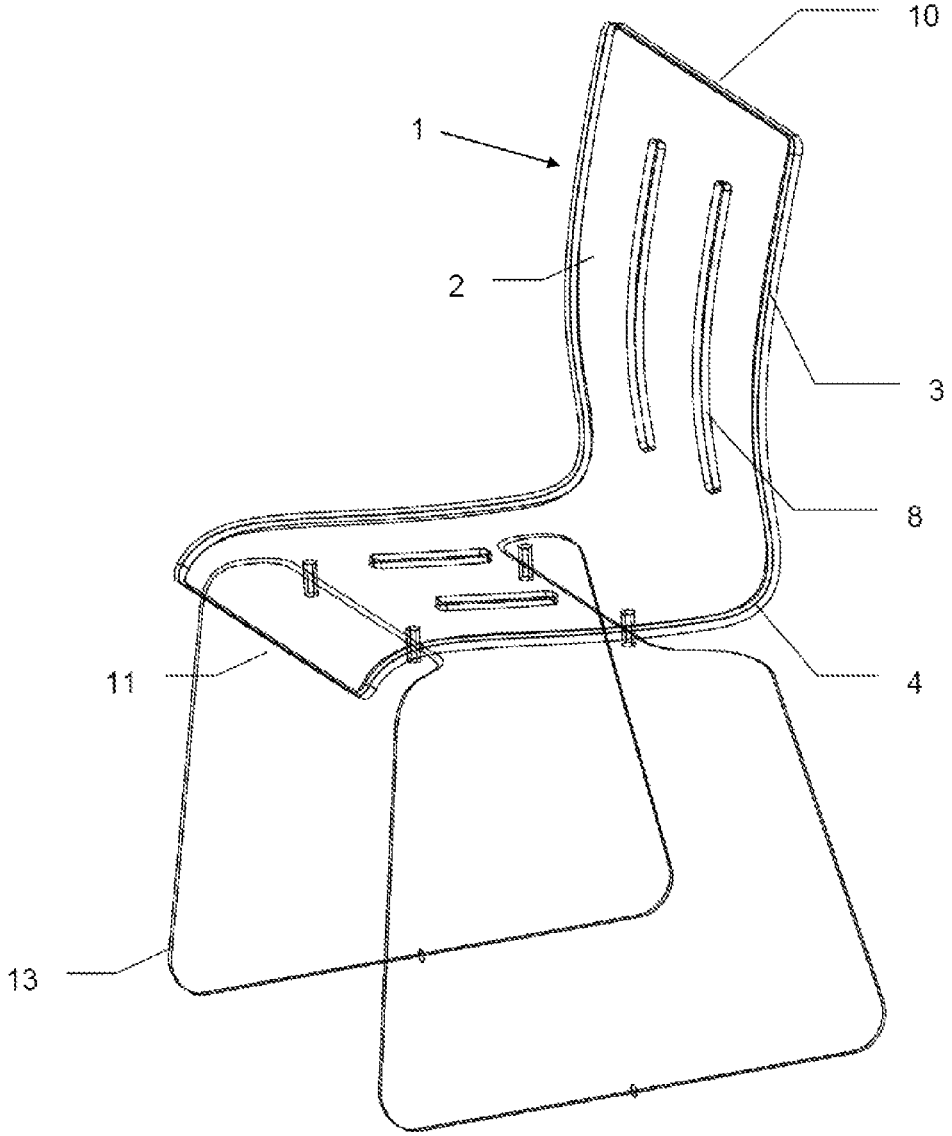

The present application is a National Phase of International Application Number PCT/DE2017/100002, filed Jan. 3, 2017, and claims the priority of German Application No. 20 2016 100 003.3, filed Jan. 4, 2016.

The invention relates to an item of seating furniture formed from two interconnected seat shells, forming as a connected unit the seat surface and backrest of the item of seating furniture, according to the preamble of claim 1.

Designing seating furniture so that it may serve for holding interchangeable decorative panels or else forms of advertising has already been disclosed in the prior art. The emphasis of the publications thus far has been to use backrests of seating furniture to hold the decorative panels or advertising representations.

German utility model DE 9412911 discloses a piece of furniture in the form of a chair, in which the backrest is formed from 2 transparent plastic panels, between which a printed sheet is inserted in an interchangeable manner. These 2 plastic panels are inserted into 2 side guiding grooves. Movable panels are to be guided accordingly to receive the sheet. Furthermore, the disclosure is limited to one portion of the item of seating furniture, namely the backrest.

The laid-open application DE 202004002419 U1 shows a three-dimensional item of seating furniture made from a flexible panel material, where advertising or company logos are to be applied directly to the flexible material.

The laid-open application DE 4428961 A1 discloses a seating furniture backrest with interchangeable decorative panel. It is provided here that the backrest is designed as a kind of frame system, in which a slot remains at the top end, in which a graphic image can be inserted. A gap space is provided between 2 panels, along with an opening at the top end, into which the graphic element or the styling film element can be inserted. The result is a backrest which can be styled with various decorative panels in the manner of a picture frame.

The laid-open application DE 19849644 A1 in turn likewise shows an item of seating furniture, which can be styled individually by inserting an advertising medium. For this purpose, it is proposed that the item of seating furniture has a transparent panel, beneath which the advertising medium can be secured. This panel is generally formed as a seat surface. This transparent panel is formed as an advertising surface which can be removed or folded away or swiveled, and which has to be unfolded and then folded back again in order to insert the advertising medium. The advertising medium is then inserted into the seat depression and the one-piece or else two-piece flap is closed once again. In this way, the basic construction of a seat shell is produced. Therefore, it is a complex structure with mechanically hinged moving parts.

Finally, there is known from the utility model DE 20 2006 002 239 U1 an advertising medium, where an advertising medium element is clamped in the form of a backrest between 2 block-like elements. Here as well, only a portion of the advertising medium also usable as seating furniture can be used as the advertising surface, namely the backrest.

There is no solution in the prior art for making possible a full-surface design of an item of seating furniture with no moving parts or mechanical components which at the same time meets a customary standard in terms of comfort, handling, stacking ability, and so forth.

Given this background, the problem which the present invention addresses is to design an item of seating furniture formed from two interconnected seat shells, forming as a connected unit the seat surface and backrest of the item of seating furniture, so that approximately the entire surface of the item of seating furniture can easily be provided with a decal sheet. It should be possible to easily replace the decal sheet and at the same time said sheet should be arranged in the item of seating furniture so that it does not become worn during use.

This is accomplished according to the invention by an item of seating furniture with the characterizing features of Claim 1.

The dependent claims deal with advantageous embodiments of the item of seating furniture.

As a result, on the one hand, thanks to the inventive solution of a base body of the item of seating furniture composed of two approximately identically shaped seat shells has no moving elements which need to be loosened or moved in order to arrange a decal sheet. Instead, due to its construction from 2 shells, the item of seating furniture itself is such that between these shells there remains the flat gap space, into which a decal sheet encompassing approximately the entire base surface of the item of seating furniture can then be inserted.

This can achieve the result that the item of seating furniture itself can be entirely changed in its appearance, in terms of the impression produced, by the introducing of the decal sheet, which may be desirable when used in the private sphere, for example to match up with other furniture, floor or wall coverings. On the other hand, however, great benefits may also be achieved especially in the realm of advertising usage of seating furniture, such as in the construction of exhibition stands, since seating furniture can thus be individually adapted to the occasion. What is intended here in particular is the possibility of adapting the furniture to particular occasions, such as product presentations or corporate events, by containing certain designs such as company logos and corporate identity.

In this context, it is especially important that the chairs meet the familiar requirements of stacking, durability, and comfort. The present solution has no shortcomings in this regard, since the seat shell is a completely continuous seat shell composed of seat surface and backrest, fully conforming to the requirements of customary standards.

A central notion of the invention is that the full-surface gap space is formed between the 2 seat shells, into which gap space a decal sheet can now be introduced through a slotlike access opening, which decal sheet thus dictates the design of the item of seating furniture through at least one transparent top seat shell. The arrangement of the access opening may be realized either at the top end of the backrest across its entire width or else through a slotlike access opening in the bottom seat shell, i.e., at the rear surface of the item of seating furniture, extending across its width.

Especially the transitional region from backrest to seat surface from the vertical to the horizontal appears to be suitable for the placement of the access opening, while it is also possible to be able to introduce here the decal sheet consisting of several segments into the flat gap space between the seat shells.

Furthermore, the introducing of the decal sheet into the flat gap space between the seat shells may be facilitated by additional apertures in the bottom rear shell, said apertures being situated extending roughly transversely to the access opening. These apertures thus run in the longitudinal direction of the base body of the item of seating furniture and enable manual inserting of the decal sheet by pushing the decal sheet into the flat gap space.

The connecting of the two approximately identically shaped seat shells occurs exclusively in their peripheral edge region either over the entire periphery or at spots. On the one hand, an adhesive bond is possible in the edge region, in which case the conformation of the seat shells must have corresponding spacers in order to create the flat gap space between the seat shells. These spacers may either be formed by a peripheral elevation on at least one of the seat shells, in the edge region and directed toward the second seat shell. But these spacers can also be arranged only at spots on the periphery in the edge region of the seat shells or else be placed as separate spacer bodies in strips or at spots between the seat shells when they are joined together.

This achieves the result that the flat gap space between the seat shells encompasses approximately the entire surface of the seating furniture, so that the full-surface design becomes possible by means of the decal sheet.

Basically, besides adhesive bonding or welding, mechanical connection means are also possible here, such as a screwing together of the seat shells being joined. One especially advantageous embodiment can be achieved by two oppositely situated strips, joining the side edges of the seat shells. These strips may expediently consist of different materials, for example a metal profile already following the shape of the side edges of the seat shells, or else plastic, which either is also already preshaped and follows the shape of the side edges of the seat shells or is formed elastically such that it can be adapted to that shape.

The use of side profile strips for the connection of the shells has several positive aspects. On the one hand, this relates to the desired spacing between the seat shells which is necessary for the introducing of the decal sheet between the seat shells. It is possible to integrate the spacer peripherally in the profile strip, so that an E-shaped profile strip is formed in cross section, the middle region of the profile strip being formed as a spacer.

Another design may be for the peripheral connecting strip to be designed as a C-profile, in which a spacer can be inserted, either as a loosely inserted or a glued roughly T-shaped profile body, which may be formed for example of an elastic plastic.

Basically, the design of the profile joining the seat shells at their side edges may show a great variety, wherein the middle region should be formed as a spacer and the outer regions join the seat shells firmly together. Different forms of fastening of these strips to the seat shells are conceivable. Advantageously, they are screwed to the seat shells, since in this way an easy assembly and disassembly of the profile strips on the seat shells is possible. But a plug-in connection is also basically conceivable, in which tonguelike projections are provided on the peripheral profile strips, which projections engage in groovelike recesses at the peripheral edges of the seat shells.

In this context, it is provided in one advantageous embodiment of the invention that a flat recess is formed on the side edges of the seat shells for a smooth connection between seat shell and side connecting strip, such that said flat recess can entirely receive the thickness of the connection profile. As a result, there is no discernible transition between the seat surface and the side connection profiles sunken into it. Thus, the connecting strips lie entirely flat against the seat shells and are sunken into the side recesses.

One positive effect in this context of this kind of connection as compared to an alternative of permanent adhesive bonding of the seat shells onto each other is that the connecting of the identically shaped seat shells, guided in parallel, by means of the side connecting strips is formed a detachable connection. This, in turn, means that the item of seating furniture can be subjected to many restyling as well as maintenance procedures.

For example, the seat shells may be lifted apart from one another again and be cleaned by loosening the side connecting strips. Alternatively, a seat shell damaged at the top side by wear and tear could also be replaced by a new seat shell, without affecting the rest of the item of seating furniture.

Another option would be, for example, a restyling of the item of seating furniture by changing the side connecting strips. This is possible, for example, when the intention is to switch from a plain styling of the item of seating furniture with a peripheral plastic strip to a higher-value styling with a brushed aluminum strip in order for example to restyle and upgrade the item of seating furniture at a later time. It is also possible to change certain color designs, which can be accomplished by the choice of the side connecting strip.

Furthermore, it is provided in one advantageous design of the seating furniture according to the invention that the connection means are likewise fastened to the legs of the chairs at the side profile strips or connecting strips and that the bottom surface or the bottom seat shell can thereby be configured free of connection means. This has the advantage that, for example, metallically formed side connecting strips are also better suited to absorbing the forces introduced into the material due to the use of the chair than is possible in a plastic in the bottom shell of the item of seating furniture.

A variety of design options is also possible here for the arrangement of the legs or the bottom frame of the chair. For example, screw fastening points may be realized on the side fastening strips, and these may either be independent of the fastening of the strip to the seat shells or combined with it.

Basically, design solutions are conceivable in which the bottom seat shell has a color design and only the top seat shell is transparent and thus the decal sheet is visible. Alternatively, however, the top and the bottom seat shell can also be made of a transparent plastic. In the case of different design of top and bottom seat shell, the bottom and possibly non-transparent seat shell may also basically consist of a different material than the transparent seat shell placed on top of it, which can generally be made of a transparent plastic.

Different support frames are basically conceivable under the base body of the item of seating furniture. Thus, for example, one could obviously use a skid frame, as well as a classical four-legged standing model, but other possible solutions are also conceivable. One modification of the items of seating furniture aims to push them against each other and mechanically connect them in a corresponding manner to form a bench.

A corresponding modified support frame of taller design as well as an adapting of the seat shells furthermore makes possible the embodiment of the item of seating furniture as an elevated bar stool or the like, thanks to a shortening of the backrest.

Figure 2:
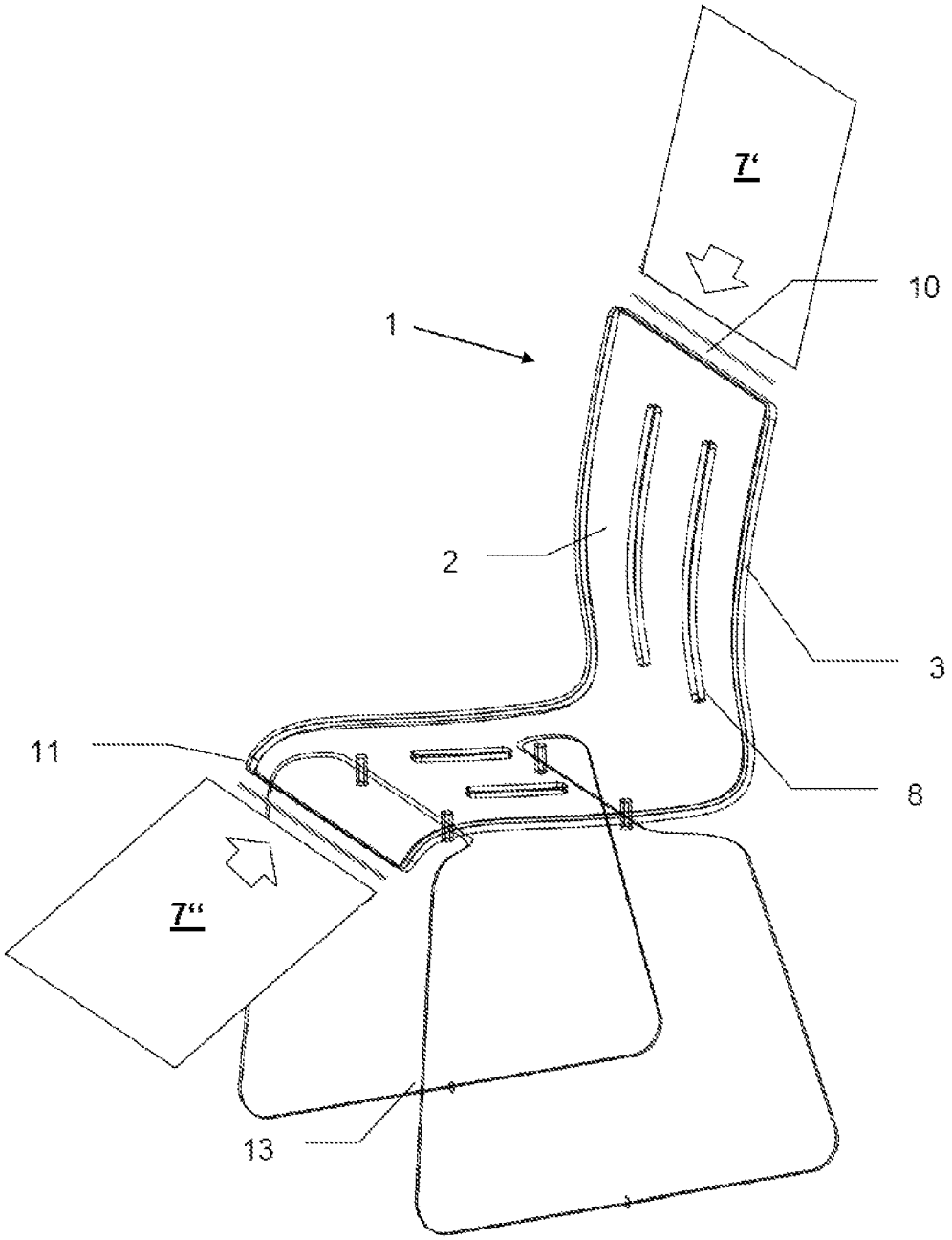
Figure 3:
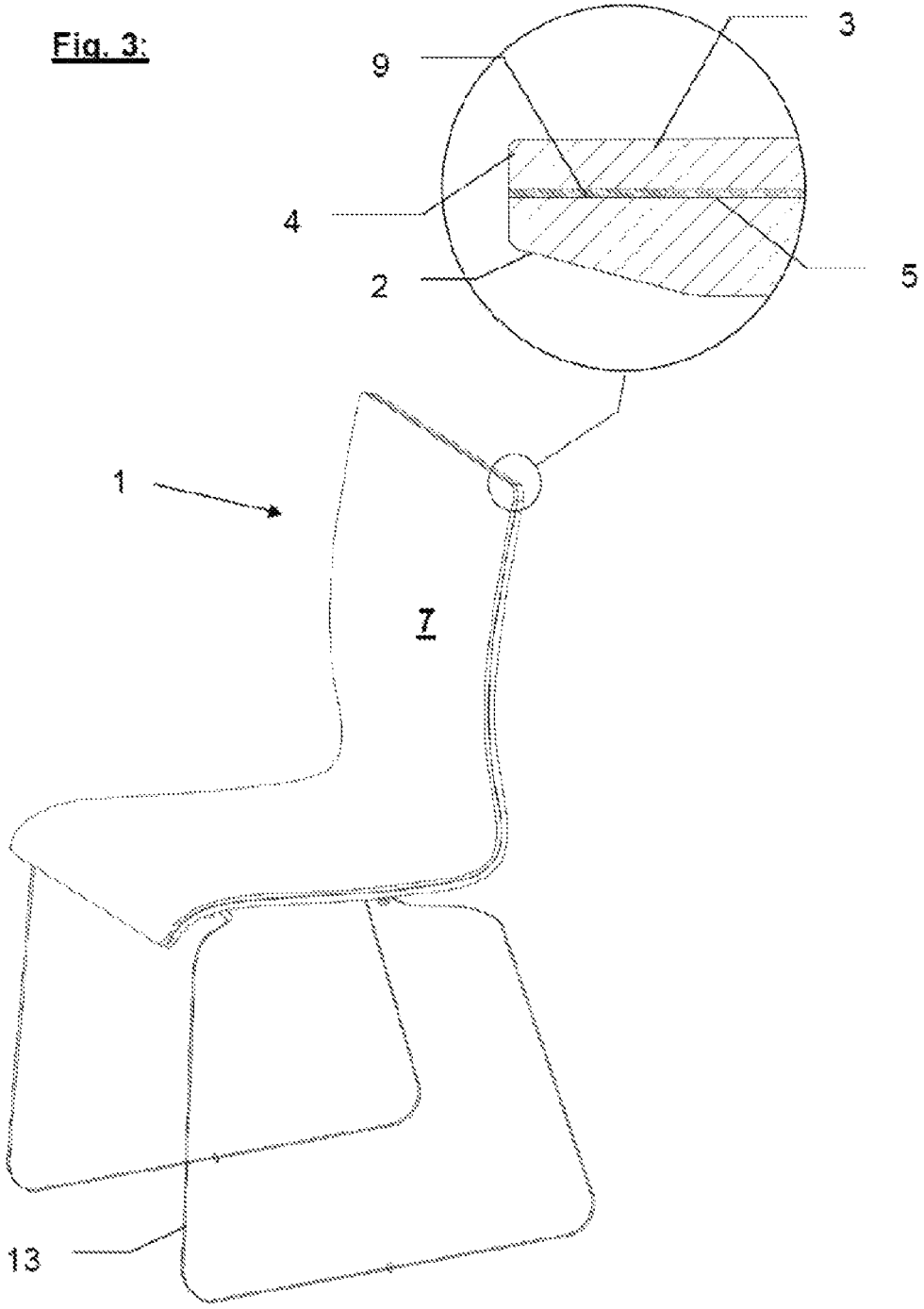
Figure 4:
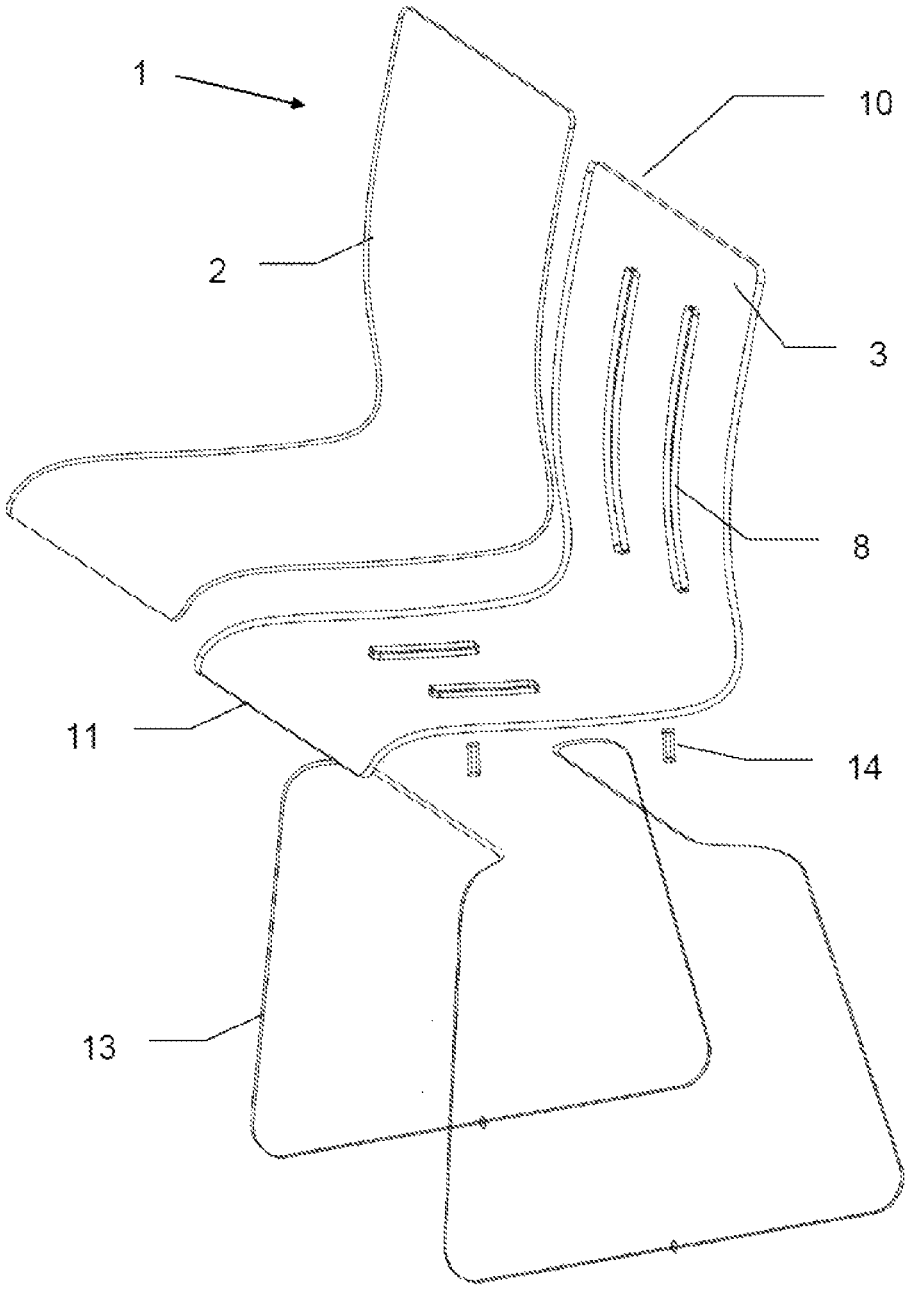
Figure 5:
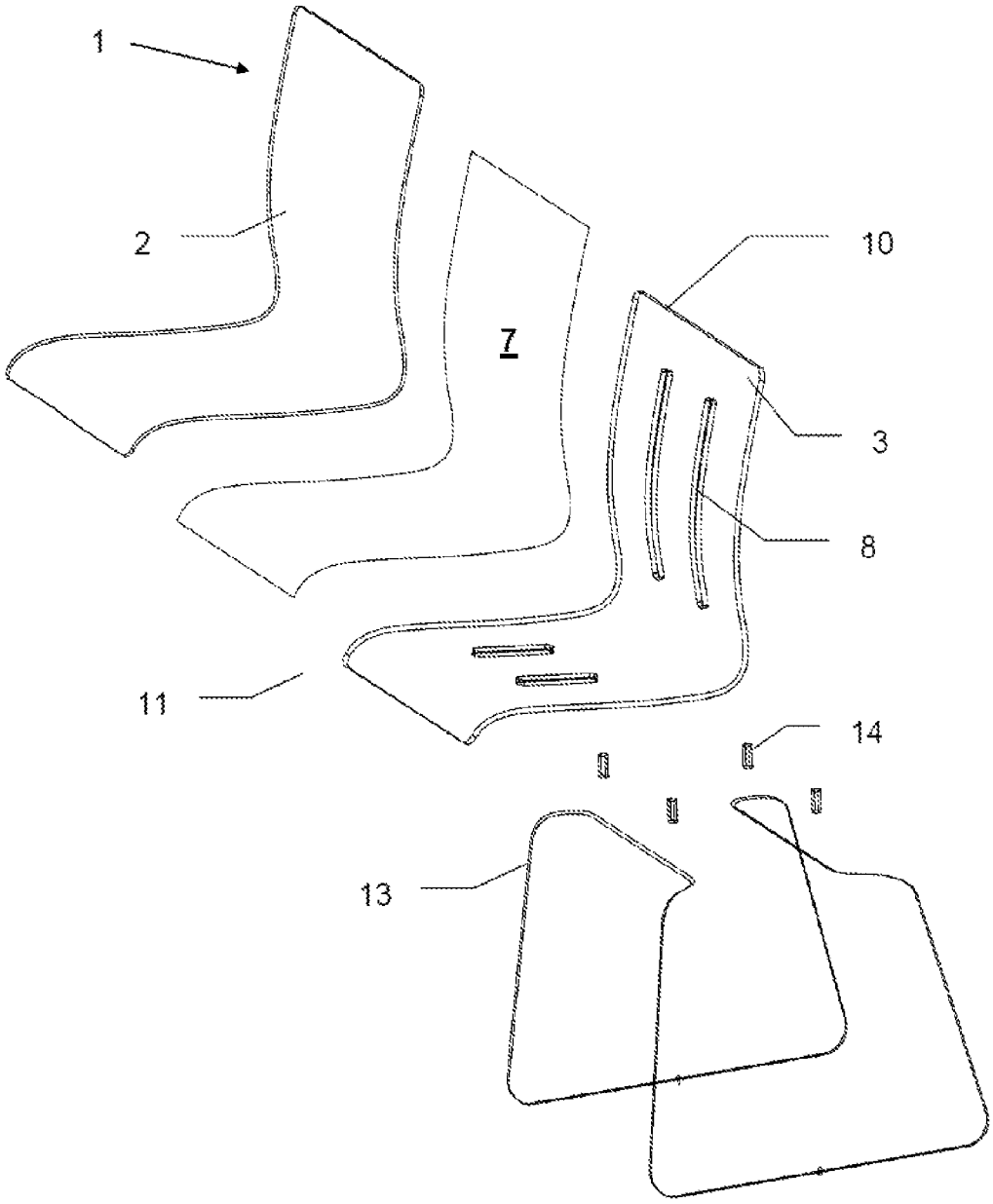
Figure 6:
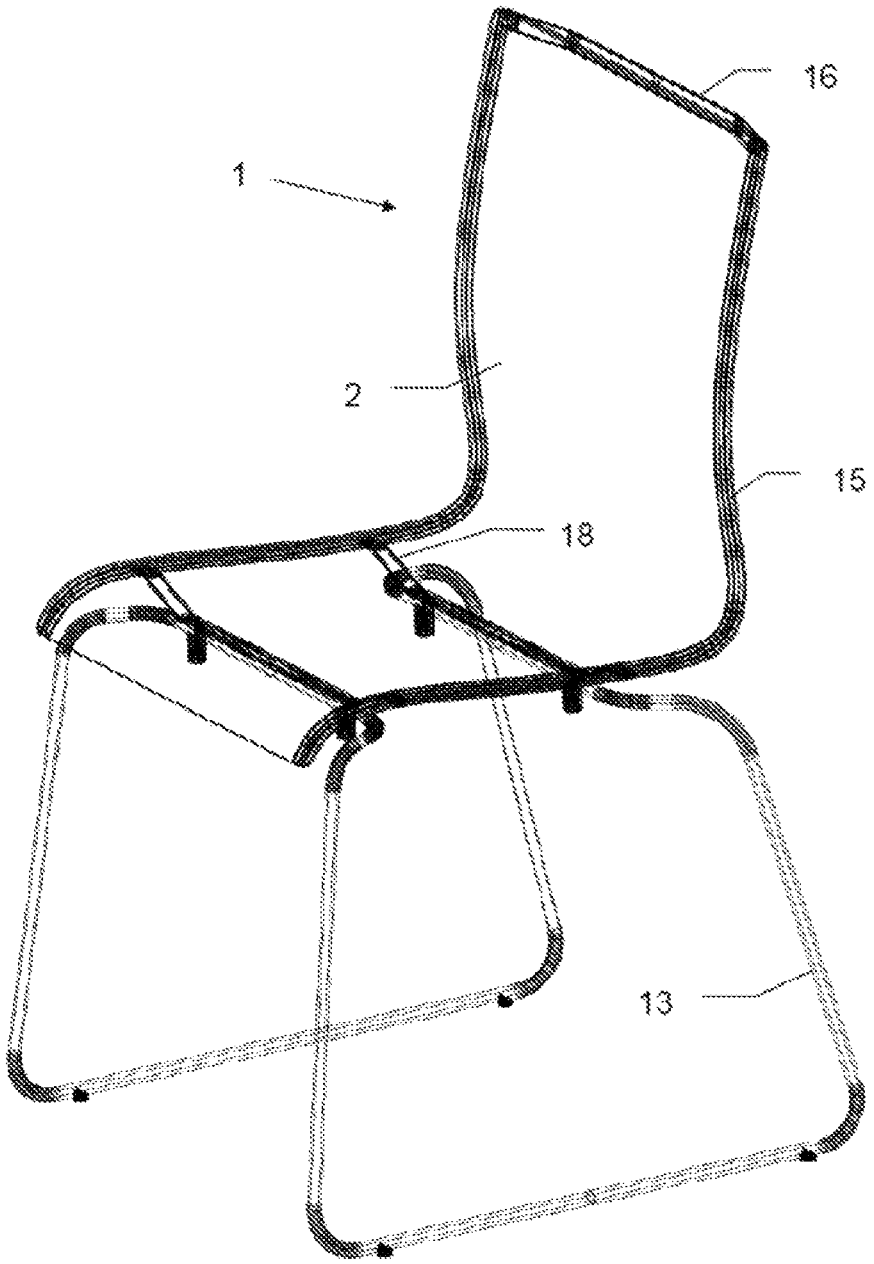
Figure 7:
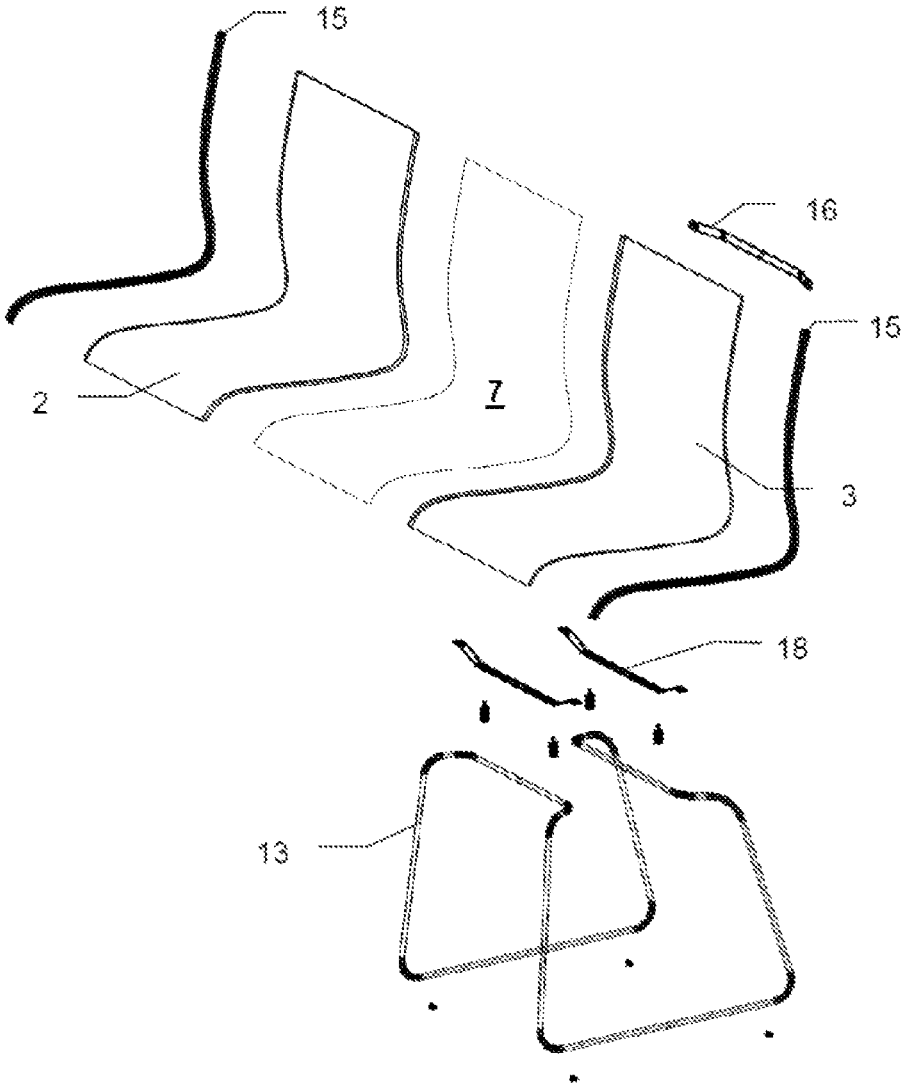
Figure 8:
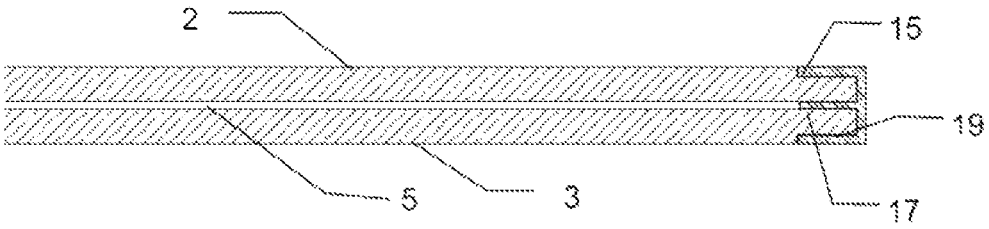
Figure 9:
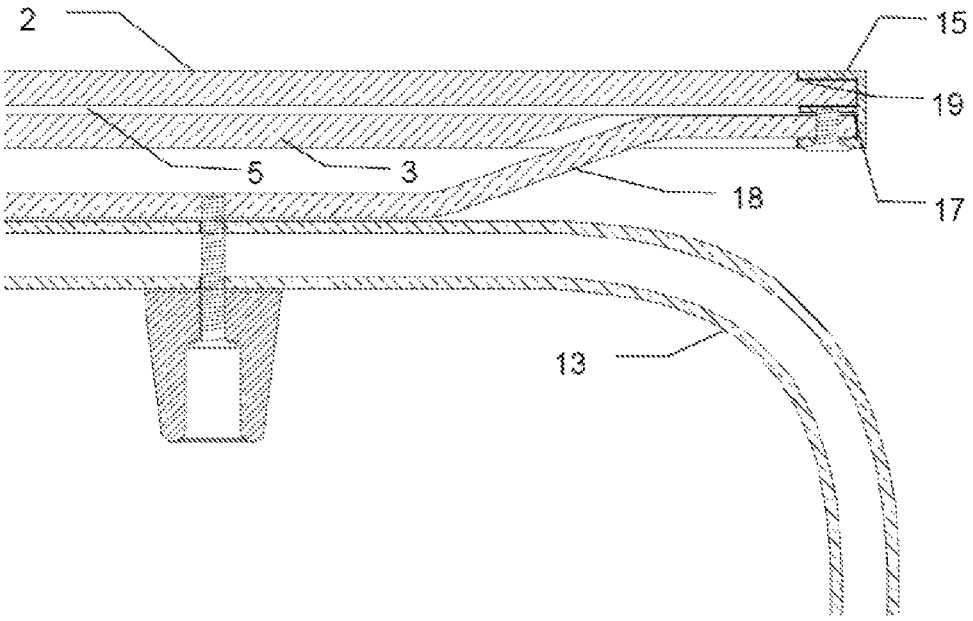

The invention will be explained more closely below with the aid of drawings, in which FIG. 1 shows a design of the item of seating furniture 1 according to the invention as a chair made of transparent plastic in a side perspective view, FIG. 2 shows a design of the item of seating furniture 1 according to the invention with two-part decorative panel 7 not yet inserted, in a side perspective view, FIG. 3 shows a design of the item of seating furniture 1 according to the invention with one-piece decorative panel 7 inserted, in a side perspective view, FIG. 4 shows a design of the item of seating furniture 1 according to the invention in a side perspective view in exploded view, FIG. 5 shows a design of the item of seating furniture 1 according to the invention in a side perspective view in exploded view with one-piece decorative panel 7 inserted, FIG. 6 shows an alternative design of the item of seating furniture 1 according to the invention with side fastening strips in a side perspective view, FIG. 7 shows the alternative design of the item of seating furniture 1 according to the invention with side fastening strips 15 in exploded view, FIG. 8 shows a sectional detail view of the seat shells 2 and 3 connected by side fastening strips 15 and FIG. 9 shows a sectional detail view of the seat shells 2 and 3 connected by side fastening strips 15 and their connection to form a substructure 13.

The design of the item of seating furniture 1 according to the invention represented in FIG. 1 is a typical design of a stackable chair with a substructure 13 as a skid frame, on which the seat shell is fastened for example by screws. Such seating furniture is widely used in public spaces such as schools or event locations. This is a representation in which the seat shell according to the invention has already been assembled from the two structural elements of the top seat shell 2 and the bottom seat shell 3. On account of the transparent top seat shell 2 here, the apertures 8 situated in the bottom seat shell 3 can also be recognized, which apertures serve to assist the introduction of a decorative panel 7, not shown here.

In FIG. 2, the decorative panel 7 is now shown, formed in this example from 2 segments 7' and 7". This is a design of the inventive solution in which an access opening 6 to the gap space 5 between the top seat shell 2 and the bottom seat shell 3 is arranged both at the front edge 11 of the seat surface of the chair and at the top edge 10 of the backrest. The segments 7' and 7" of the decorative panel 7 have been fitted here, arrows showing the pushing-in direction.

FIG. 3 now shows on the one hand the item of seating furniture 1 according to the invention with inserted decorative panel 7, by means of which a full-surface representation of for example a graphic representation or a company logo can be arranged so as to occupy the entire seat surface of the chair.

On the other hand, an enlarged cutout is reproduced here, revealing the transition of the edge region as a connecting region between the top seat shell 2 and the bottom seat shell 3 with the adhesive bond 9 arranged in between, as well as the gap space 5 between the seat shells 2 and 3, adjoining the adhesive bond 9.

The exploded representation of FIG. 4 in turn illustrates the structural elements from which the item of seating furniture 1 is assembled. This shows the substructure 13 as a skid frame, being the load-bearing element, and also connection means 14, serving for the fastening of the seat shell to the substructure 13. It becomes clear in this FIG. 4 that the transparent seat shell is composed of a closed top seat shell 2 and the identically configured bottom seat shell 3 underneath, wherein the bottom seat shell 3 has additional apertures 8 which are useful when introducing the decorative panel 7. In the present case, the access opening 6 needed for this may be arranged at the top edge 10 of the backrest or else at the front edge 11 of the seat surface or at both edges.

Finally, FIG. 5 again shows an exploded drawing, where the placement of a one-piece decorative panel 7 between the two seat shells 2 and 3 can also be seen. As can be seen, the decorative panel 7 covers roughly the entire surface of the seat shell and thus the entire seat surface and backrest of the seat shell can be used for decoration.

FIGS. 6 and 7 in turn refer to an alternative design in which the seat shells 2 and 3 are not glued together, but instead are interconnected by means of connecting strips 15 fitted in detachable manner on the side edge regions 4. Basically, these connecting strips 15 can be formed as profiles of different cross section, but in the design shown it can be seen in FIGS. 8 and 9 that an E-profile 17 is used here.

The E-profile 17 consists here of the arms resting against the seat shells 2 and 3 on the sides and joining them, as well as the middle arm extending between the seat shells 2 and 3, representing the spacer for keeping the seat shells 2 and 3 at the desired distance from one another. This middle arm may consist of a material different from the other material of the profile, such as an elastic plastic in the case of an aluminum profile.

There is furthermore shown a support strip 16 at the top end of the backrest, which support strip is fastened to the side connecting strips 15, in the present example by screwing. This serves for the easier handling of the seating furniture 1.

Additional strips 18 are also arranged on the horizontally extending bottom limbs of the connecting strips 15, forming the connection to the substructure 13. This has the advantage that these regions where gravity forces bearing on the item of seating furniture are particularly active are placed not in the plastic of the seat shell 3, but rather in the connecting strips 15, made of metal for example, which on the one hand improves the durability of the item of seating furniture 1 and on the other hand assists the assembly, disassembly, and replacement of these structural parts.

FIGS. 8 and 9 illustrate the arrangement of the side connecting strip 15 in section. This is an E-profile 17, where the middle arm of the profile 17 produces the required gap space 5 between the seat shells 2 and 3. Furthermore, it can be seen that a recess 19 runs along the peripheral side edges of the seat shells 2 and 3 such that the top and bottom arms of the E-profile 17 engage into it and thus a smooth transition to the surface of the seat shells 2 and 3 is produced.

FIG. 9 furthermore illustrates one possible fastening of a substructure 13 of the item of seating furniture 1 to the seat shells 2 and 3 by means of the side connecting strips 15. In this design, this is accomplished by a material recess in the bottom seat shell 3, into which an angled end of a fastening strip 19 for fastening to the substructure 13 engages and is screwed together with the side connecting strip 15. This fastening strip, in turn, is screwed together with the substructure 13, for example a skid frame.

What is claimed is:

1. Item of seating furniture formed from two interconnected seat shells, forming as a connected unit the seat surface and backrest of the item of seating furniture, wherein the top and bottom seat shells joined to form the item of seating furniture are approximately identical in design and these are joined to each other only in their edge region such that a free, narrow and flat gap space remains between the seat shells, which accommodates a decal sheet via a slotlike access opening at the top end of the backrest and/or at the front edge of the seat surface and/or in the rear surface of the item of seating furniture, which decal sheet has roughly the size of the surface of the item of seating furniture.

2. The item of seating furniture according to claim 1, wherein the slotlike access opening for introducing the decal sheet into the gap space between the seat shells is arranged at the top edge of the backrest and/or at the front edge of the seat surface, extending across their entire width.

3. The item of seating furniture as claimed in claim 1, wherein the slotlike access opening for introducing the decal sheet is arranged at the rear surface in a curvature region of a transition from the backrest to the seat surface.

4. The item of seating furniture as claimed in claim 1, wherein besides the slotlike access openings that run transversely, other apertures are arranged in the bottom seat shell, said other apertures run approximately at right angles to the slotlike access openings to guide the decal sheet into the gap space between the seat shells.

5. The item of seating furniture as claimed in claim 1, wherein the item of seating furniture is in the form of a chair or a bar stool.

6. The item of seating furniture as claimed in claim 1, wherein spacers to produce the flat gap space between the seat shells are arranged at the edge between the seat shells, and wherein these spacers are part of one or both seat shells along their periphery or at spots, or are arranged as separate bodies between the seat shells.

7. The item of seating furniture as claimed in claim 1, wherein the flat gap space between the seat shells comprises an entire area of the item of seating furniture minus connection regions in the edge region of the item of seating furniture, so that a full-surface design is possible by means of the decal sheet inserted in the gap space.

8. The item of seating furniture as claimed in claim 1, wherein at least one of the seat shells is transparent.

9. The item of seating furniture as claimed in claim 1, wherein several items of chair-type seating furniture are configured to be detachably joined to form a bench.

10. The item of seating furniture as claimed in claim 1, wherein the decal sheet is insertable and interchangeable and composed of several segments.

11. The item of seating furniture as claimed in claim 1, wherein the seat shells are interconnected by means of an adhesive bond in their peripheral edge regions.

12. The item of seating furniture as claimed in claim 1, wherein the seat shells are interconnected by means of connecting strips in their laterally peripheral edge regions, and said connecting strips interconnect the laterally peripheral edge regions continuously or partially in a detachable manner.

13. The item of seating furniture as claimed in claim 12, wherein the connecting strips are formed as a C-profile or E-profile in cross section, outer edges of the seat shells being grasped by the profiles.

14. The item of seating furniture as claimed in claim 12, wherein spacers for producing the flat gap space between the seat shells are an integral part of an E-profile of the connecting strip, or are inserted as separate bodies into the profiles of the connecting strips.

15. The item of seating furniture as claimed in claim 12, wherein the connecting strips have receptacles for fastening means or have integrated fastening means for detachable fastening to the seat shells, wherein the fastening means engage into correspondingly formed and arranged receptacles in side edge regions of the seat shells.

16. The item of seating furniture as claimed in claim 15, wherein the connecting strips have tonguelike fastening means for detachable fastening to grooves on the seat shells.

17. The item of seating furniture as claimed in claim 12, wherein fastening points of a substructure and/or of other strips serving for supporting of the item of seating furniture are arranged on the connecting strips.

18. The item of seating furniture as claimed in claim 12, wherein flat recesses are arranged in side edge regions of the seat shells for sunken resting of the connecting strips against the seat shells.

19. An item of seating furniture, comprising:

a top seat shell defining a seat surface of the item; and a bottom seat shell interconnected with the top seat shell and defining a backrest of the item, wherein the top and bottom seat shells are substantially identical in shape, the top and bottom seat shells are joined to each other only at corresponding edge regions thereof and a gap space remains between the first and second seat shells, the gap space receives a decal sheet via a slot access opening at at least one of a top edge of the backrest, a front edge of the seat surface, or a rear surface of the backrest, and a size of the decal sheet is substantially the same as a size of the seat surface.

* * * * *